US006848585B2

(12) United States Patent
VanLandingham

(10) Patent No.: US 6,848,585 B2
(45) Date of Patent: Feb. 1, 2005

(54) RACK FOR REDUCED HEIGHT WASHING COMPARTMENT

(75) Inventor: Wayne M. VanLandingham, Jackson, TN (US)

(73) Assignee: Maytag Corporation, Newton, IA (US)

( * ) Notice: Subject to any disclaimer, the term of this patent is extended or adjusted under 35 U.S.C. 154(b) by 78 days.

(21) Appl. No.: 10/036,571

(22) Filed: Nov. 9, 2001

(65) Prior Publication Data

US 2003/0089672 A1 May 15, 2003

(51) Int. Cl.[7] ..... A47F 5/00
(52) U.S. Cl. ..... 211/41.9; 211/41.8
(58) Field of Search ..... 211/41.8, 41.9; D32/2, 3

(56) References Cited

U.S. PATENT DOCUMENTS

| | | | | |
|---|---|---|---|---|
| 2,159,365 A | | 5/1939 | Barrie | |
| 2,648,588 A | | 8/1953 | Ruspinoi | |
| 3,126,098 A | | 3/1964 | Geiger et al. | |
| 3,752,322 A | | 8/1973 | Fiocca et al. | |
| 4,046,261 A | | 9/1977 | Yake | |
| 4,183,437 A | | 1/1980 | Crawford et al. | |
| 4,917,248 A | * | 4/1990 | Friskney | 211/41.8 |
| 5,351,837 A | * | 10/1994 | Smith | 211/41.8 |
| 5,601,195 A | * | 2/1997 | Finola et al. | 211/41.8 |
| 5,649,630 A | * | 7/1997 | Remmler | 211/41.8 |
| 6,571,965 B1 | * | 6/2003 | Beck et al. | 211/41.8 |

* cited by examiner

*Primary Examiner*—Robert W. Gibson, Jr.
(74) *Attorney, Agent, or Firm*—McKee, Voorhees & Sease, P.L.C.

(57) ABSTRACT

A dishwasher rack includes foldable tines adapted to be retained in one or more positions between an upright position and a lowered position. The lower ends of the tines in each set are fixed relative to one another, while the upper ends of the tines can be spaced progressively farther apart from one another as the tines are folded from the upright position to the lowered position. Therefore, a dinner plate or other tall object supported by the tines will be tilted progressively farther from a vertical plane as the tines are folded toward the lowered position.

19 Claims, 9 Drawing Sheets

RACK FOR REDUCED HEIGHT WASHING COMPARTMENT

BACKGROUND OF THE INVENTION

Dishwashers typically have a door which can be opened to provide access to the dishwashing chamber, and upper and lower racks to hold dishes, bowls, glasses, cups, and other objects to be washed. One of the racks is normally designed to hold dinner plates, serving platters, and other tall objects, while the other rack has limited vertical space or clearance such that dinner plates and the like will not fit. More contemporary dishwashers include a pull-out upper drawer which is shallow so as to have limited vertical space for dinner plates and the like. However, it is sometimes desirable to be able to place taller objects, such as dinner plates, in the shallower rack or drawer for washing.

Accordingly, a primary objective of the present invention is the provision of an improved dishwasher rack adapted to hold tall objects having a height greater than the vertical clearance above the rack.

Another objective of the present invention is the provision of a dishwasher rack having foldable tines to allow objects such as dinner plates to be tilted or leaned so as to fit within the dishwasher chamber for washing.

A further objective of the present invention is the provision of a dishwasher rack having first and second rows of adjustable tines, with each row being independently foldable with respect to the other row.

Another objective of the present invention is the provision of an improved dishwasher rack having two sets of tines, with the lower ends of the tines being fixed relative to one another and the upper ends of the tines being spaced progressively farther apart from one another as one or both of the sets are folded from an upright position to the lowered position, such that a dinner plate supported by the tines will be tilted progressively farther from a vertical plane as the tines are folded outwardly toward the lowered position.

Still another objective of the present invention is the provision of an improved dishwasher rack having adjustable tines, which is economical to manufacture and durable in use.

These and other objectives will become apparent from the following description of the invention.

BRIEF SUMMARY OF THE INVENTION

The dishwasher rack of the present invention includes a bottom wall, a front wall, a back wall, and opposite side walls. First and second sets of tines are pivotally mounted in the rack so as to be foldable between an upright position and a lowered position. Clip members associated with each set of tines allow each set to be retained in one or more positions between the upright and lowered positions. The lower ends of each set of tines are fixed relative to one another while the upper ends are independently adjustable such that tall objects to be washed, such as dinner plates, can be leaned or tilted from a vertical plane so as to fit within the dishwasher chamber.

DETAILED DESCRIPTION OF THE INVENTION

Figure 4:
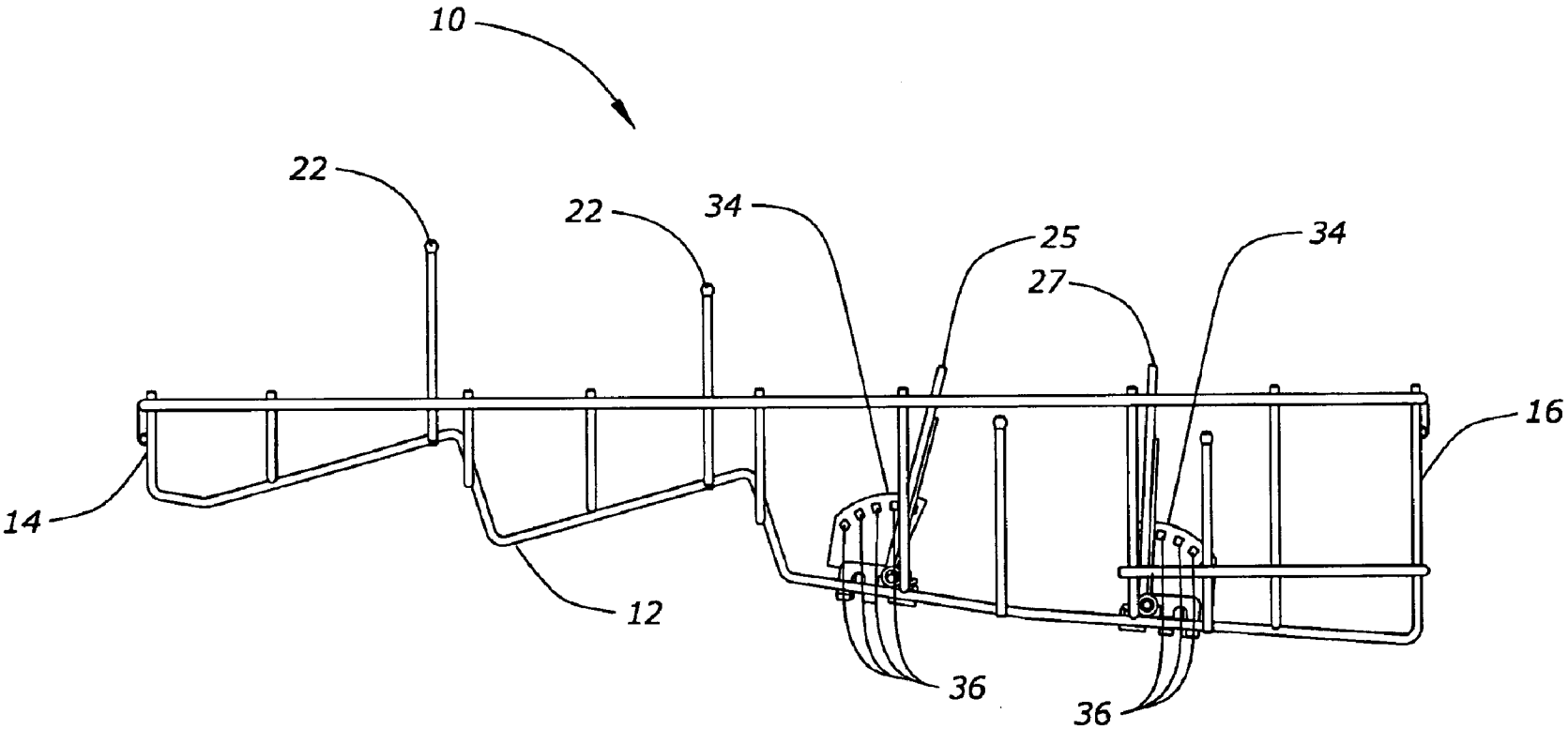
FIG. 4 is a side elevation view of the rack showing the tines in an upright position.
Figure 5:
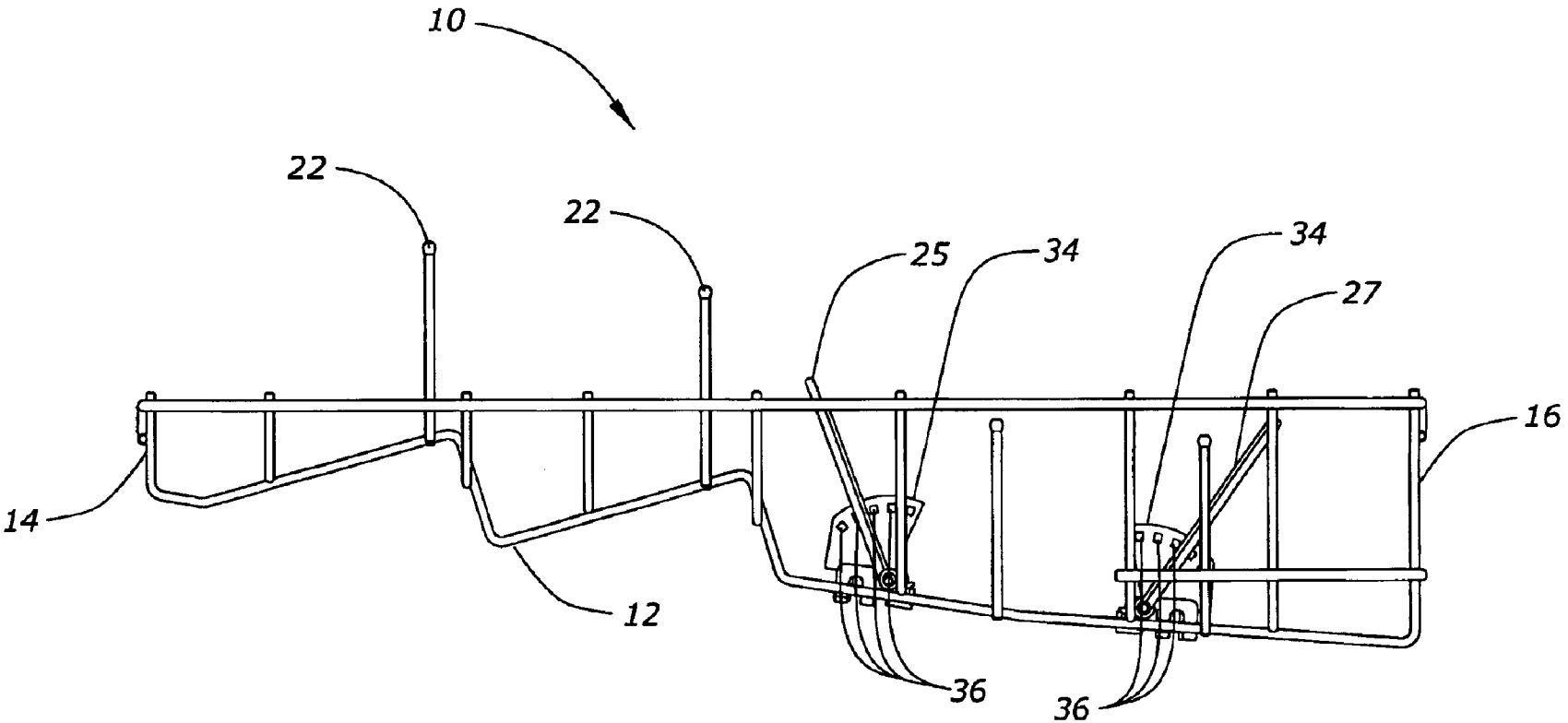
FIG. 5 is a side elevation view showing the tines in an intermediate position between the upright and lowered positions.
Figure 6:
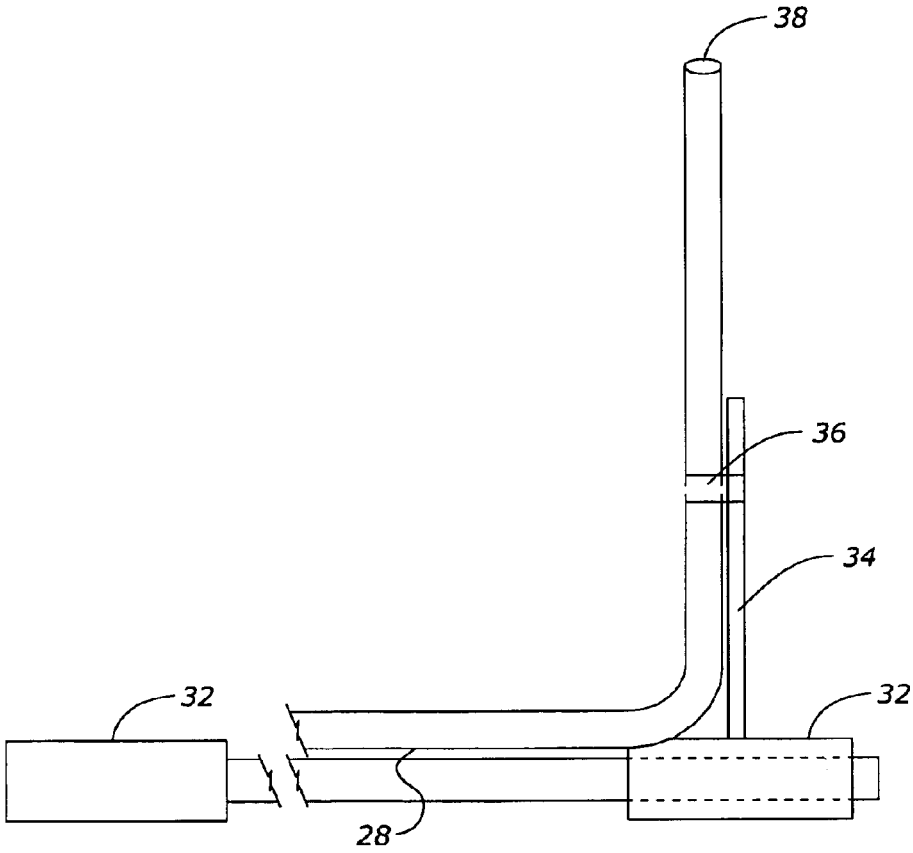
FIG. 6 is a sectional view taken along lines 6—6 of FIG. 2.
Figure 7:
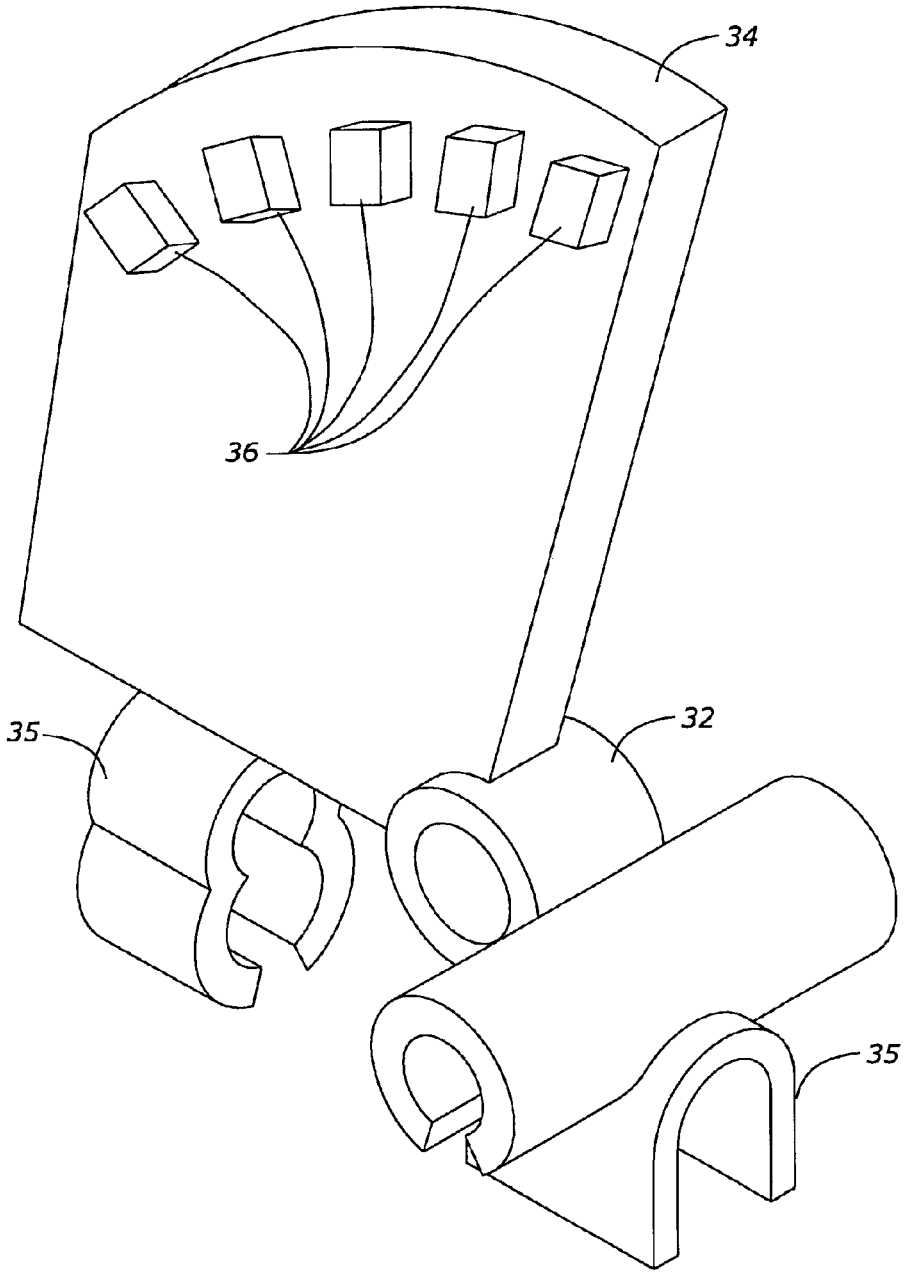
FIG. 7 is an enlarged perspective view of the clip which is a part of the present invention.
Figure 8:
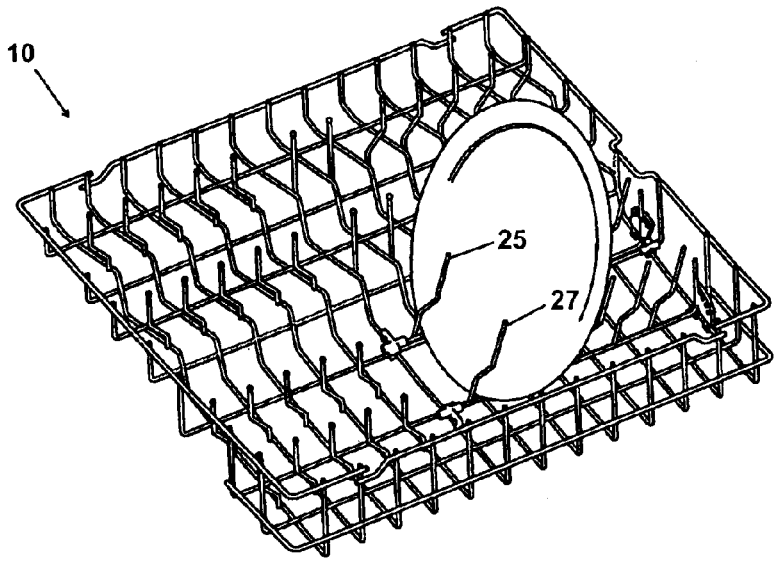
FIG. 8 is a perspective view of the rack of the present invention with the tines in an upright position with a dinner plate placed in the rack.
Figure 9:
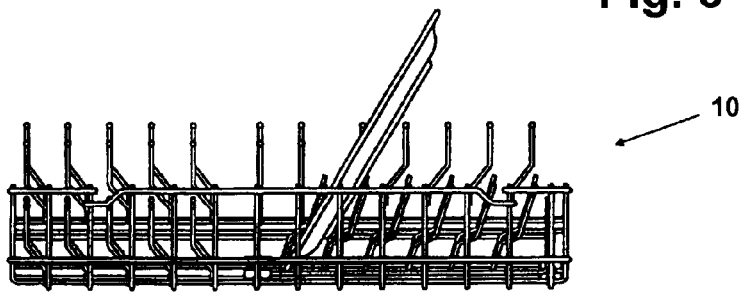
FIG. 9 is a side elevation view of the rack and the dinner plate shown in FIG. 8.
Figure 10:
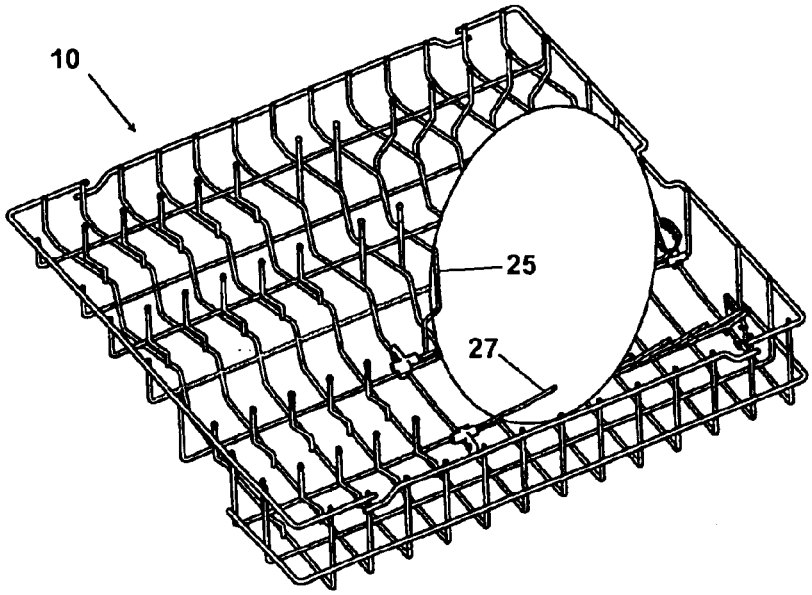
FIG. 10 is a perspective view similar to FIG. 8, but showing the tines spread outwardly so that the dinner plate is positioned at a greater angle within the rack.
Figure 11:
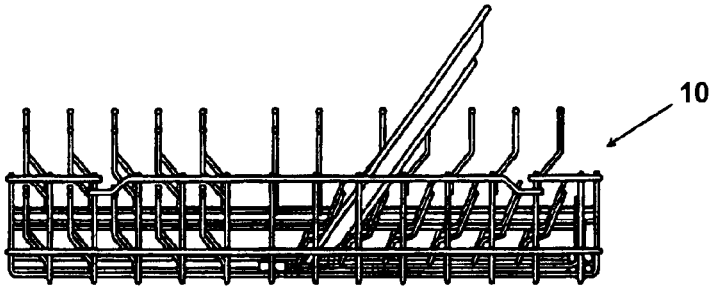
FIG. 11 is a side elevation view of the rack and plate of FIG. 10.

The dishwasher rack of the present invention is generally designated in the drawings by the reference numeral 10. The rack is generally rectangular and made of a wire-type construction. The rack 10 includes a bottom wall 12, a front wall 14, a back wall 16 and opposite side walls 18, 20. As seen in FIGS. 4 and 5, the bottom wall 12 may be stepped to hold cups and glasses, and sloped to allow for drainage of rinse water from the tops of objects being washed in the dishwasher. The rack 10 also includes a plurality of tines 22 to support objects being washed in the dishwasher.

The above construction of the rack 10 is conventional and does not constitute a part of the present invention.

The present invention is directed towards adjustable tines 25, 27 which allow tall objects, such as dinner plates, platters, and the like to be placed in the rack 10 at an angle so as to fit within the dishwasher chamber for washing. More particularly, the rack 10 includes first and second sets or rows 24, 26 of tines 25, 27. The tines 25, 27 in each of the first and second sets 24, 26 extend upwardly from horizontally disposed legs 28, 30, respectively. The legs 28, 30 have opposite ends which are pivotally mounted within bushings 32 attached to the bottom wall 12 of the rack 10, such that the tines 25, 27 are foldable between an upright position substantially perpendicular to the bottom wall 12 and a lowered position substantially parallel to the bottom wall 12. Each set 24, 26 of tines 25, 27 is thus foldable independent of the other set. A pair of clip members 34 are provided on the rack 10 adjacent the back wall 16 thereof. Each clip member 34 includes a plurality of spaced apart protrusions 36. Each clip 34 has resilient members 35 to mount the clip on the wire rack 10. An upstanding arm 38 on each leg 28, 30 is adapted to be received and retained between pairs of the spaced apart protrusions 36 of the clip member 34 to retain the tines 25, 27 in a selected position between the upright and lowered positions. The tines 25, 27 are shown in the upright position in FIG. 4 and in one of the intermediate positions in FIG. 5.

Thus, the lower ends of the tines 25, 27 are fixed relative to one another, while the upper ends of the tines 25, 27 are spaced progressively further apart as the tines are folded or pivoted from the upright position to the lowered position. In other words, the spacing between the pair of tines 25A, 27A and the next pair of tines 25B, 27B is constant, while the lateral spacing between the upper ends of tines 25A and 27A, and between the upper ends of tines 25B and 27B, is adjustable.

When dinner plates or the like are placed between adjacent pairs of tines 25, 27, the plate will stand more upright when the tines 25,27 are in the upright position,.and the plate will be tilted or leaned progressively rearwardly as the tines 25,27 are moved toward the lowered position, as shown in FIG. 8-11. Therefore, plates and the like having a height or diameter greater than the vertical clearance above the rack 10 can still be placed in the rack 10 for washing, since the plate will be tilted to fit within the space above the rack 10.

Figure 1:
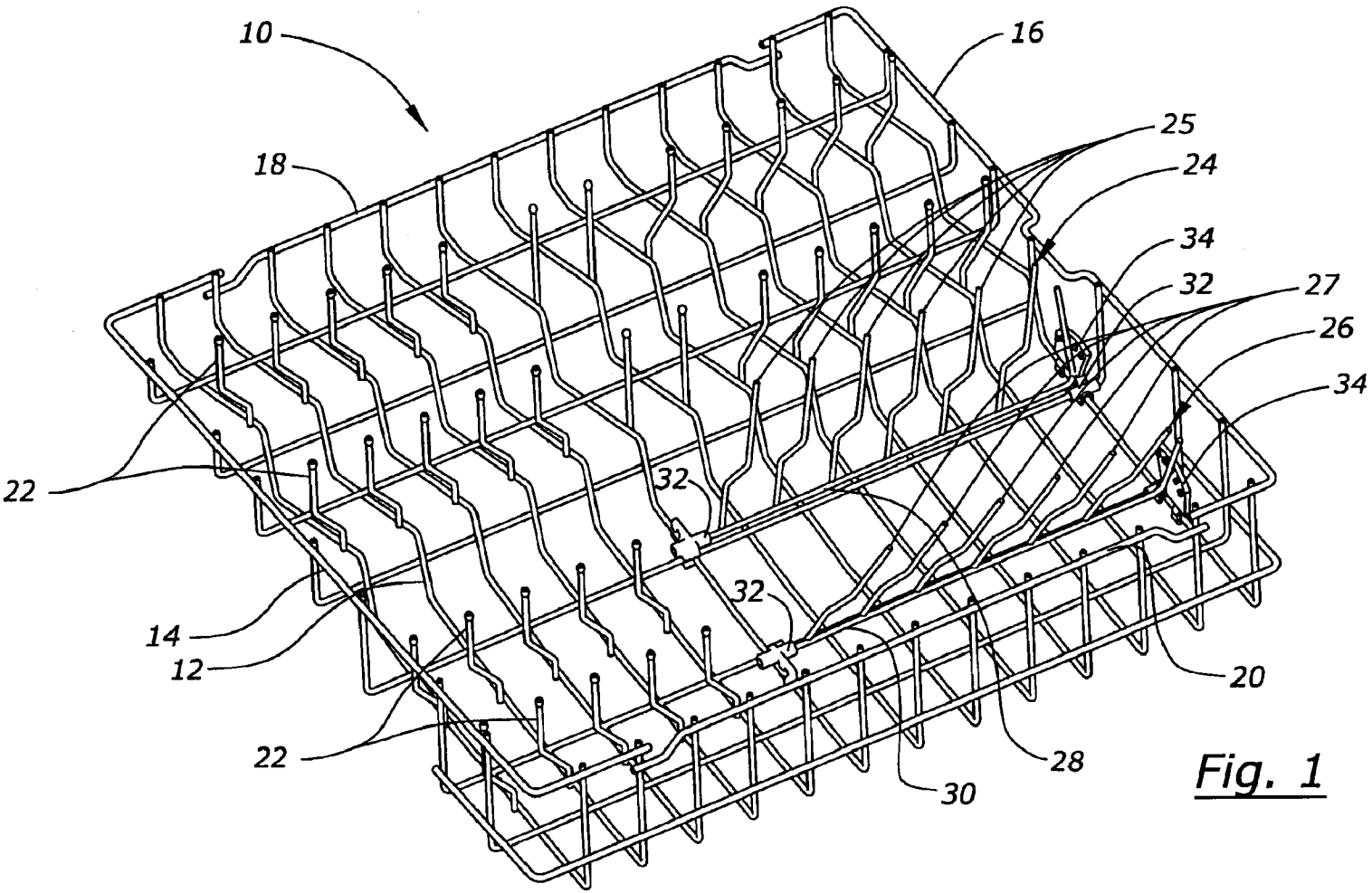
FIG. 1 is a perspective view of the dishwasher rack of the present invention.
Figure 2:
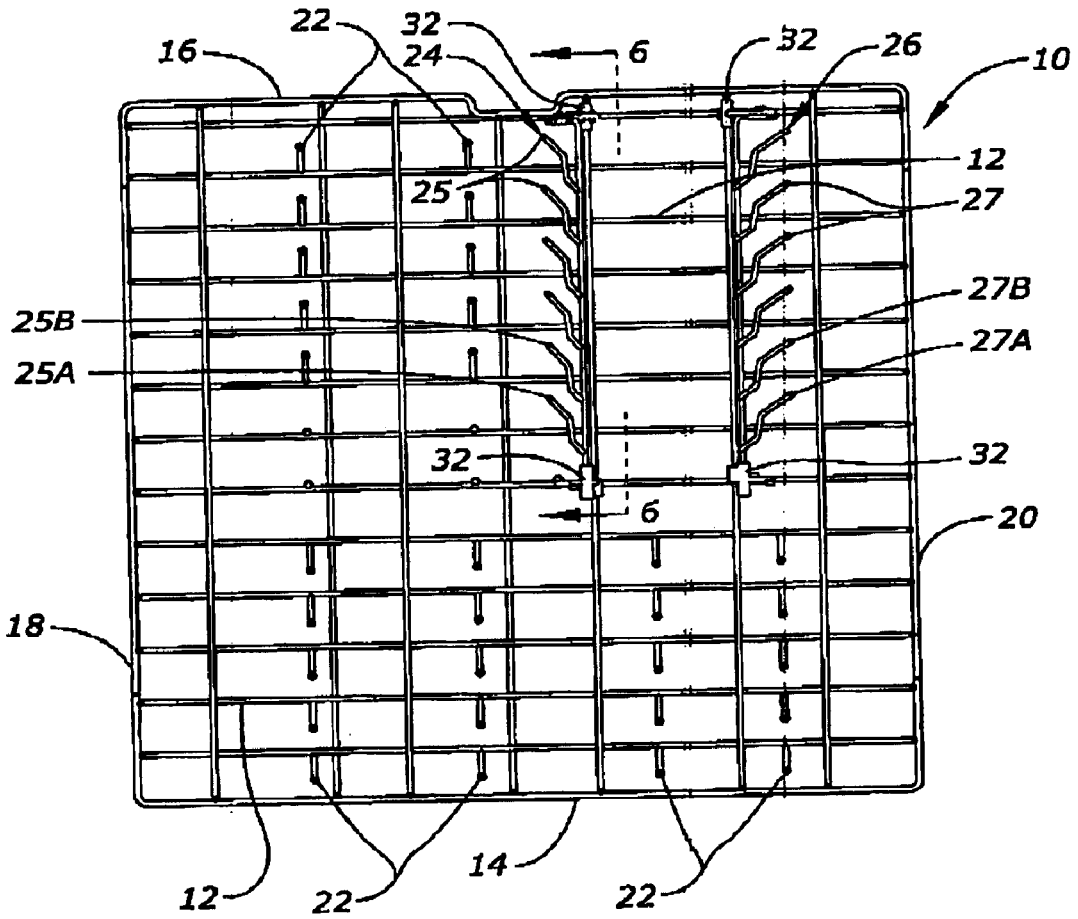
FIG. 2 is a plan view of the dishwasher rack of the present invention.
Figure 3:
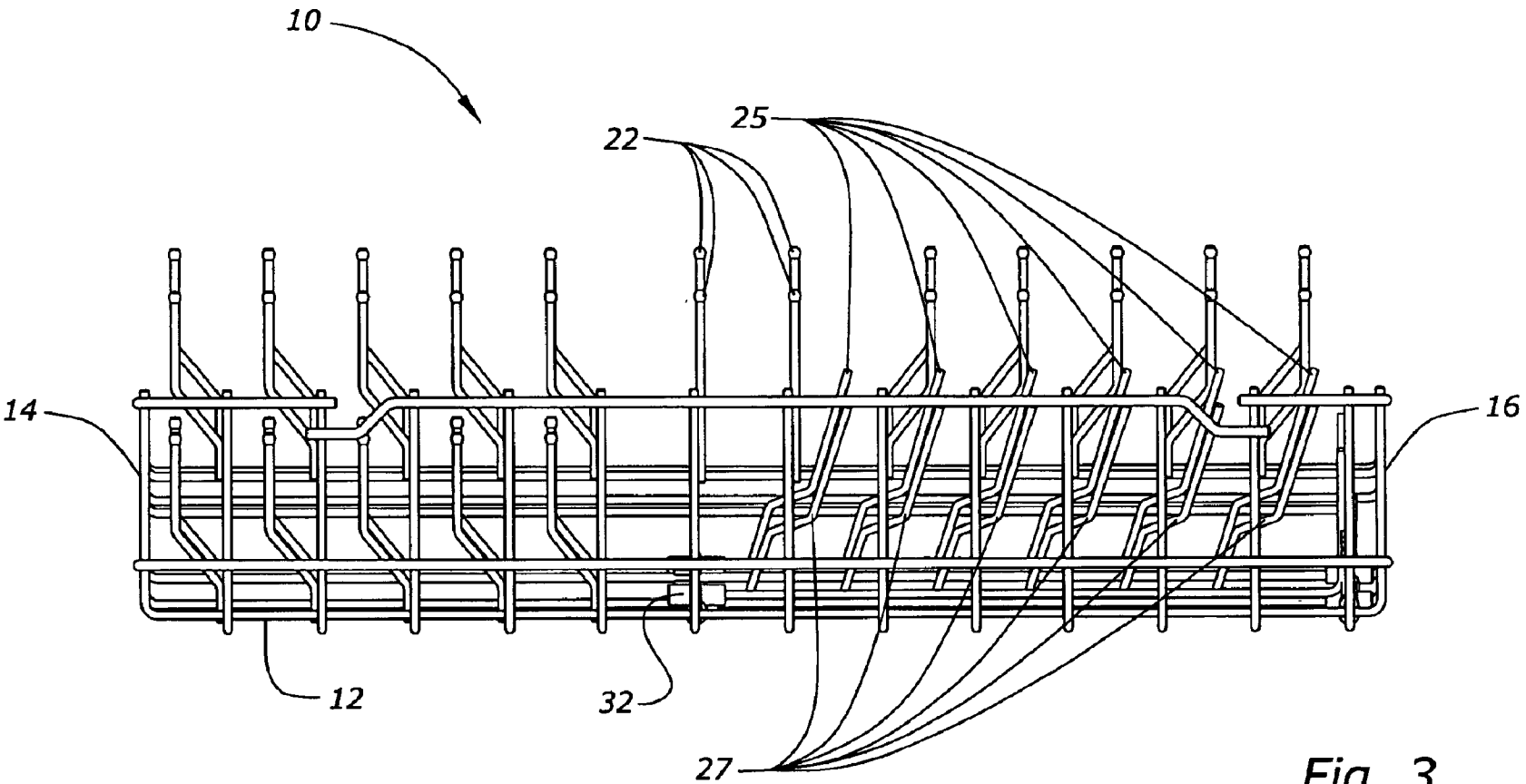
FIG. 3 is a side elevation view of the dishwasher rack of the present invention.

Preferably, the tines 25, 27 are angled rearwardly and are stepped, as best seen in FIGS. 1 and 3. It is understood that the precise shape of the tines and the location of the tines can be varied from that shown in the drawings.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A dishwasher rack, comprising:

a substantially rectangular wire receptacle defined by a bottom wall, a front wall, a back wall, and opposite side walls;

spaced apart first and second rows of tines having lower ends and upper ends, and being free from connections above the lower ends between adjacent tines, so as to receive objects to be washed therebetween;

the tines in each row being independently foldable in opposite directions between an upright position and a lowered position;

the upper ends of the tines of the first row being spaced progressively farther apart from the tines of the second row as one or both of the rows of tines are folded from the upright position to the lowered position such that the object supported by the tines will be tilted progressively farther from a vertical plane as the tines are folded toward the lowered position; and a clip member associated with the tines to permit selected folding of each row of the tines to one or more positions between the upright and lowered positions.

2. The dishwasher rack of claim 1 wherein the clip member includes a plurality of protrusions and an adjacent arm operatively connected to the tines is adapted to be received between pairs of the protrusions to retain the tines in the selected position.

3. The dishwasher rack of claim 1 wherein the tines are interconnected adjacent the lower ends so as to fold in unison.

4. The dishwasher rack of claim 3 further comprising a horizontal leg to interconnect the tines adjacent the lower ends of the respective rows, the leg having opposite ends pivotally mounted to the bottom wall of the rack.

5. The dishwasher rack of claim 1 wherein the tines are angled rearwardly.

6. The dishwasher rack of claim 1 wherein each of the tines is stepped.

7. The dishwasher rack of claim 1 wherein the lower ends of the tines in each row being fixed relative to one another, and the upper ends of the tines in each row being spaced progressively farther apart from one another as one or both of the rows of tines are folded from the upright position to the lowered position such that the objects supported by tines will be tilted progressively farther from a vertical plane as the tines are folded toward the lowered position.

8. A dishwasher rack for receiving a dinner plate having a diameter of at least 8 inches, comprising:

a bottom;

a front;

a back;

opposite sides;

first and second horizontal legs extending along the bottom;

a plurality of tines extending from each of the first and second legs in a non-perpendicular, angled orientation and being free from obstruction between upper and lower ends of each tine so as to angle the dinner plate to fit within a washing space, above the bottom of the rack having a height of less than the diameter of the plate;

at least one of the legs being pivotally mounted on the bottom, such that the tines thereon are foldable between upright and lowered positions so that the dinner plate tilts at an increasing angle as the tines are pivoted from the upright position to the lowered position; and a clip member on the rack adapted to engage one of the foldable tines to hold the foldable tines in a position between the upright and lowered positions.

9. The dishwasher rack of claim 8 wherein both legs are pivotally mounted on the bottom so that the tines on each leg are foldable in opposite directions.

10. The dishwasher rack of claim 9 wherein the tines on the first leg are independently foldable with respect to the tines on the second leg.

11. The dishwasher rack of claim 8 wherein the clip member includes a plurality of protrusions adapted to receive an arm on the one foldable leg to hold the foldable tines in a selected position.

12. The dishwasher rack of claim 8 wherein the tines are angled rearwardly.

13. The dishwasher rack of claim 8 wherein each of the tines is stepped.

14. The dishwasher rack of claim 8 wherein each of the tines have upper and lower ends, the lower ends of the tines on one leg being fixed relative to the tines on the other leg, and the upper ends of the tines on the respective legs being spaced progressively farther apart from one another as one or both of the legs are pivoted to fold the tines thereon from the upright position to the lowered position, such that a plate supported by tines will be tilted progressively farther from a vertical plane as the tines are folded toward the lowered position.

15. A dishwasher rack, comprising:

a bottom, a front, a back and opposite sides;

first and second sets of tines, at least one set being selectively foldable for retention in one or more positions between an upright position and a lowered position; the first and second sets of tines being spaced apart and rearwardly angled and being free from obstruction between the upper and lower tine ends so as to angle tall objects to fit within a reduced height washing space above the rack bottom, wherein the height of the objects is greater than the height of the washing compartment; and each of the tines have upper and lower ends, the lower ends of the tines of one set being fixed relative to the tines of the other set, and the upper ends of the tines of one set being spaced progressively farther apart from the tines of the other set as one or both of the sets of tines are folded from the upright position to the lowered position such that the tall object supported by tines will be tilted progressively farther from a vertical plane as the tines are folded toward the lowered position.

16. The dishwasher rack of claim 15 further comprising a clip on the rack to hold the foldable tines in the selected position.

17. The dishwasher rack of claim 16 wherein the clip has a plurality of protrusions and an arm operatively connected to the tines is receivable between a pair of protrusions to retain the tines in the selected position.

18. The dishwasher rack of claim 15 wherein both sets of tines are foldable independent of one another and in opposite directions.

19. The dishwasher rack of claim 15 further comprising a horizontal leg for each of the sets of tines to interconnect the tines of the respective sets, each leg having opposite ends pivotally mounted to the bottom wall of the rack.

* * * * *